US008745784B2

(12) United States Patent
Cole et al.

(10) Patent No.: US 8,745,784 B2
(45) Date of Patent: Jun. 10, 2014

(54) MATTRESS SYSTEM

(75) Inventors: Nicholas Cole, Southampton (GB); Richard Taggerty, Fareham (GB)

(73) Assignee: Talley Group Limited, Romsey, Hampshire (GB)

( * ) Notice: Subject to any disclaimer, the term of this patent is extended or adjusted under 35 U.S.C. 154(b) by 263 days.

(21) Appl. No.: 12/934,986

(22) PCT Filed: Mar. 4, 2009

(86) PCT No.: PCT/GB2009/000596
§ 371 (c)(1),
(2), (4) Date: Sep. 27, 2010

(87) PCT Pub. No.: WO2009/122123
PCT Pub. Date: Oct. 8, 2009

(65) Prior Publication Data

US 2011/0035880 A1 Feb. 17, 2011

(30) Foreign Application Priority Data

Mar. 31, 2008 (GB) ..... 0805796.0

(51) Int. Cl.
*A47C 27/00* (2006.01)

(52) U.S. Cl.
USPC ..... 5/423; 5/652.1; 5/652.2; 5/714; 5/724; 5/726; 5/706; 5/710

(58) Field of Classification Search
USPC ..... 5/421, 423, 289, 652.1, 652.2, 706, 5/714, 724, 726
See application file for complete search history.

(56) References Cited

U.S. PATENT DOCUMENTS 4,907,308 A * 3/1990 Leininger et al. ..... 5/713
5,005,240 A * 4/1991 Vrzalik ..... 5/713

(Continued)

FOREIGN PATENT DOCUMENTS

GB 1532219 A 11/1976
WO WO 96/07353 A1 3/1996
WO WO03/022190 A2 3/2003

OTHER PUBLICATIONS

Written Opinion of the International Searching Authority dated Oct. 5, 2010 for International Application No. PCT/GB2009/000596, 6 pages.

(Continued)

*Primary Examiner* — Robert G Santos
*Assistant Examiner* — Richard G Davis
(74) *Attorney, Agent, or Firm* — Workman Nydegger

(57) ABSTRACT

There is described a mattress system (20) comprising a mattress, an airflow driving device (14) and a heat adjustment unit (28). The mattress has a mattress cover (24) enclosing an internal mattress (10) such that a mattress air chamber is formed between the internal mattress and the mattress cover. The airflow driving device is in fluid communication with the mattress air chamber via an air chamber inlet and an air chamber outlet. The airflow driving device is operable to drive an airflow through the mattress air chamber from the air chamber inlet to the air chamber outlet. The heat adjustment unit is for heating or cooling the airflow so as to control a temperature of the airflow within the mattress air chamber. There is also described a mattress. In addition, there is described an apparatus for providing a temperature-controlled airflow through a mattress air chamber connected to the apparatus.

17 Claims, 5 Drawing Sheets

(56) References Cited

U.S. PATENT DOCUMENTS

| | | | | |
|---|---|---|---|---|
| 5,090,074 | A | 2/1992 | Scales et al. | |
| 5,611,096 | A * | 3/1997 | Bartlett et al. | 5/617 |
| 5,970,550 | A | 10/1999 | Gazes | |
| 6,119,292 | A | 9/2000 | Haas | |
| 6,151,740 | A * | 11/2000 | Morimoto et al. | 5/710 |
| 6,460,209 | B1 * | 10/2002 | Reeder et al. | 5/690 |
| 7,107,641 | B2 * | 9/2006 | Davis | 5/710 |
| 7,914,611 | B2 | 3/2011 | Vrzalik et al. | |
| 2002/0138904 | A1 | 10/2002 | Wong | |
| 2003/0046762 | A1 * | 3/2003 | Stolpmann | 5/421 |
| 2004/0133987 | A1 | 7/2004 | Reeder et al. | |
| 2006/0080778 | A1 | 4/2006 | Chambers | |
| 2006/0179579 | A1 * | 8/2006 | Phillips et al. | 5/713 |
| 2007/0006385 | A1 * | 1/2007 | Davis | 5/710 |
| 2007/0234481 | A1 * | 10/2007 | Totton et al. | 5/714 |

OTHER PUBLICATIONS

UK Search Report dated Jul. 6, 2012 for Great Britain Application No. GB1208139.4, 2 pgs.

International Search Report dated Apr. 24, 2009 for International Application No. PCT/GB2009/000596, 2 pages.

UK Search Report dated Jun. 9, 2008 for Great Britain Application No. GB0805796.0, 1 page.

* cited by examiner

MATTRESS SYSTEM

CROSS-REFERENCED TO RELATED APPLICATION(S)

This application is a National Phase Patent Application of International Application Number PCT/GB2009/000596, filed on Mar. 4, 2009, which claims priority to and the benefit of GB Application No. 0805796.0, filed Mar. 31, 2008

FIELD OF THE INVENTION

The present invention relates to a mattress system. The invention also relates to the mattress itself and to an apparatus for providing a temperature-controlled airflow through a mattress air chamber connected to the apparatus.

Although the invention is primarily concerned with inflatable mattresses to provide yielding support for a recumbent human body, as used herein the term "mattress" is intended to include resilient cushions, seats and like body-support structures. Furthermore, a mattress according to the invention may be used to support any form of load, including loads other than a human body.

BACKGROUND OF THE INVENTION

Surgical patients undergoing major procedures and general anaesthesia face several consequences during and following the operation. Keeping the body temperature of a patient within normal limits is an important goal while in the operating room. Likewise, prevention of post-operative pressure ulcers requires addressing the patient's skin pressures during their immobilised state.

There are currently products available to provide warming to patients who are undergoing surgery and who are under anaesthesia. These have limitations to the surgeon and patient.

One type of conventional heater system which is currently available is similar to a normal electric-blanket for a bed. Such heater systems are placed under the patient between the patient and the mattress to allow for an efficient heat transfer. However, these systems are not compatible with the use of dynamic pressure-relieving mattress systems such as the Talley Quattro range of products available from Talley Group Limited of Abbey Park Industrial Estate, Premier Way, Romsey, Hampshire SO51 9DQ, United Kingdom.

Dynamic pressure-relieving mattress systems of this kind are intended to alleviate the possibility of pressure sores by having an inflatable mattress with a number of separate inflation chambers that are inflatable independently of one another to a desired inflation pressure. Generally, each inflation chamber includes a respective plurality of mutually spaced inflatable cells. For example, FIG. 1 is a schematic representation of such an inflatable mattress 10 including a number of inflation cells 12 which are arranged to form four separate inflation chambers 12*a*, 12*b*, 12*c* and 12*d*. The inflatable mattress 10 is elongate in direction y. The inflation cells 12 are each elongate in orthogonal direction x and are arranged side by side (at different y coordinates) so as to extend widthways across the mattress 10.

In use, a pump and control unit 14 is connected to the mattress 10 via four separate air hoses 16*a*, 16*b*, 16*c* and 16*d*. In FIG. 1, hoses 16*a* and 16*b* are schematically shown as solid lines and hoses 16*c* and 16*d* are schematically shown as dashed lines. The hoses 16 are used to independently vary the inflation pressure of each inflation chamber over time. For example, in a particular mode of operation, the second, third and fourth inflation chambers 12*b*, 12*c* and 12*d* will initially be inflated, with a reduced pressure in the inflation cells of the first inflation chamber 12*a*. After a specified time period, the configuration will change such that the first inflation chamber 12*a* will be inflated and the pressure in the second inflation chamber 12*b* will be reduced. Next, the second inflation chamber 12*b* will be inflated and the pressure in the third inflation chamber 12*c* will be reduced. And, finally, the third inflation chamber 12*c* will be inflated and the pressure in the fourth inflation chamber 12*d* will be reduced. The pump and control unit 14 continually cycles through these four configurations such that, at any given time, the patient is only supported by 75% of the load-bearing upper surface of the mattress 10. This helps to prevent pressure sores by relieving interface pressure against a patient's soft tissue when immobilized for extended time periods, for instance during extended surgical operation procedures. Further details regarding dynamic pressure-relieving mattress systems are given in EP 0,732,886 in the name of Talley Group Limited.

The conventional electric-blanket-like heater systems mentioned above are not suitable for use with dynamic pressure-relieving mattress systems because the contact surface between the patient and the mattress is modified from being a stretch material (of the dynamic pressure-relieving mattress) to a non-stretch material or material with reduced-stretch characteristics (of the heater system). Therefore long surgical procedures (which could be as long as 20 hours) can cause the onset of serious pressure sores as the patient is immobilised for such a long period.

Other heater systems are known in which a light gown or cover is placed over the patient, and warm air is blown over the patient beneath the overlying cover or gown. Such heater systems only allow warming of the patient from their top side and limit the accessibility of the patient to the surgeon.

The present invention seeks to provide an alternative system which provides various advantages over those of the prior art. In particular, the present invention aims to provide an effective patient heating system which is compatible with the use of a dynamic pressure-relieving mattress system.

SUMMARY OF THE INVENTION

According to a first aspect of the present invention, there is provided a mattress system comprising a mattress having a mattress cover enclosing an internal mattress such that a mattress air chamber is formed between the internal mattress and the mattress cover. The mattress system further comprises an airflow driving device in fluid communication with the mattress air chamber via an air chamber inlet and an air chamber outlet. The airflow driving device is operable to drive an airflow through the mattress air chamber from the air chamber inlet to the air chamber outlet. Also, the mattress system comprises a heat adjustment unit for heating or cooling the airflow so as to control a temperature of the airflow within the mattress air chamber.

Such a mattress system provides an effective way of heating a patient from beneath during an operation, for example. Furthermore, access to the patient by the surgeon is not compromised. Also, since the temperature-conditioned airflow does not contact the patient lying on the mattress, infection risk and unwanted airflows around the patient are both reduced.

In addition, the mattress system of the present invention is suitable for use with a dynamic-pressure-relieving mattress without compromising the effectiveness of the pressure-relieving therapy. The use of this system is therefore intended for patients who may be a high risk for hypothermia during surgery and/or for pressure ulcers post-operatively.

The heat adjustment unit may comprise a heater for heating the airflow and/or an air-conditioning unit and/or a refrigeration unit for cooling the airflow.

The airflow driving device may comprise a fan or an air pump, for example. Although the terms "air and "airflow" have been used in the claims and the description, it will be appreciated that gases other than air may be suitable for use in the present invention.

Advantageously, the mattress system further comprises an air inlet conduit extending within the mattress air chamber from the air chamber inlet. The air inlet conduit comprises a plurality of mutually spaced holes for introducing the temperature-controlled airflow into the mattress air chamber at a plurality of locations.

In one embodiment, the air inlet conduit and the holes are arranged (e.g. in size and location) to provide a substantially constant temperature distribution of the airflow within the mattress air chamber. In an alternative embodiment, the mattress is elongate and the air inlet conduit and the holes are arranged (e.g. in size and location) to provide a temperature distribution of the airflow within the mattress air chamber which varies along the length of the mattress.

Optionally, the mattress is elongate and the air chamber inlet is located at or near a first corner of the mattress such that the air inlet conduit extends along a longitudinal edge of the mattress towards a second corner of the mattress. In one embodiment, the air inlet conduit further extends from the second corner of the mattress along a widthwise edge of the mattress towards a third corner of the mattress and then partially extends back along the opposite longitudinal edge of the mattress towards the fourth corner of the mattress.

Advantageously, the mattress system further comprises an air outlet conduit extending within the mattress air chamber to the air chamber outlet. The air outlet conduit comprises at least one hole for conveying the temperature-controlled airflow out of the mattress air chamber. In one embodiment, the air chamber outlet is located at or near the fourth corner of the mattress and the air outlet conduit extends approximately one third of the way along the longitudinal edge of the mattress towards the third corner of the mattress.

Advantageously, the mattress system further comprises a temperature sensor arranged to sense a temperature of the airflow. In one embodiment, the temperature sensor comprises a first temperature sensor arranged to sense a temperature of a first airflow from the heat adjustment unit to the air chamber inlet. Alternatively/additionally, the temperature sensor comprises a return temperature sensor arranged to sense a temperature of a return airflow from the air chamber outlet to the heat adjustment unit.

Advantageously, the mattress system further comprises a processor operable to control the heat adjustment unit based on the sensed airflow temperature. More advantageously, the mattress system further comprises means for selecting a desired temperature distribution of the airflow within the mattress air chamber. In this embodiment, the processor is further operable to control the heat adjustment unit based on the selected temperature distribution.

Advantageously, the internal mattress is an inflatable mattress. In one embodiment, the inflatable mattress comprises at least two separate inflation chambers that are inflatable independently of one another to a desired inflation pressure. Alternatively/additionally, each inflation chamber comprises a respective plurality of mutually spaced inflatable cells. A pump and a control system may be provided that are together operable to independently vary the inflation pressure of each inflation chamber over time.

The mattress has a load-bearing upper surface for receiving a load. Advantageously, the lower surface of the mattress comprises an insulating layer.

Advantageously, the mattress is radiolucent.

According to a second aspect of the present invention, there is provided a mattress comprising an internal mattress. A mattress cover encloses the internal mattress such that a mattress air chamber is formed between the internal mattress and the mattress cover. The mattress cover comprises an air chamber inlet and an air chamber outlet arranged to allow a temperature-controlled airflow to pass through the mattress air chamber from the air chamber inlet to the air chamber outlet. An air inlet conduit extends within the mattress air chamber from the air chamber inlet. The air inlet conduit comprises a plurality of mutually spaced holes for introducing the temperature-controlled airflow into the mattress air chamber at a plurality of locations. An air outlet conduit extends within the mattress air chamber to the air chamber outlet. The air outlet conduit comprises at least one hole for conveying the temperature-controlled airflow out of the mattress air chamber.

According to a third aspect of the present invention, there is provided an apparatus for providing a temperature-controlled airflow through a mattress air chamber connected to the apparatus. The apparatus comprises: an air outlet for provision of a first airflow from the apparatus to the connected mattress air chamber; an air inlet for receiving a return airflow from the connected mattress air chamber to the apparatus; an airflow driving device for driving an airflow from the air inlet towards the air outlet so as to drive the first and return airflows; a heat adjustment unit for heating or cooling the airflow; a first temperature sensor arranged to sense a temperature of the first airflow; a return temperature sensor arranged to sense a temperature of the return airflow; and a processor operable to control the heat adjustment unit based on the sensed first airflow temperature, the sensed return airflow temperature and a pre-selected desired temperature distribution of the airflow within the mattress air chamber.

Other preferred features of the present invention are set out in the appended claims.

BRIEF DESCRIPTION OF THE DRAWINGS

Embodiments of the present invention will now be described by way of example with reference to the accompanying drawings in which.

DETAILED DESCRIPTION OF A PREFERRED EMBODIMENT

Figure 2:
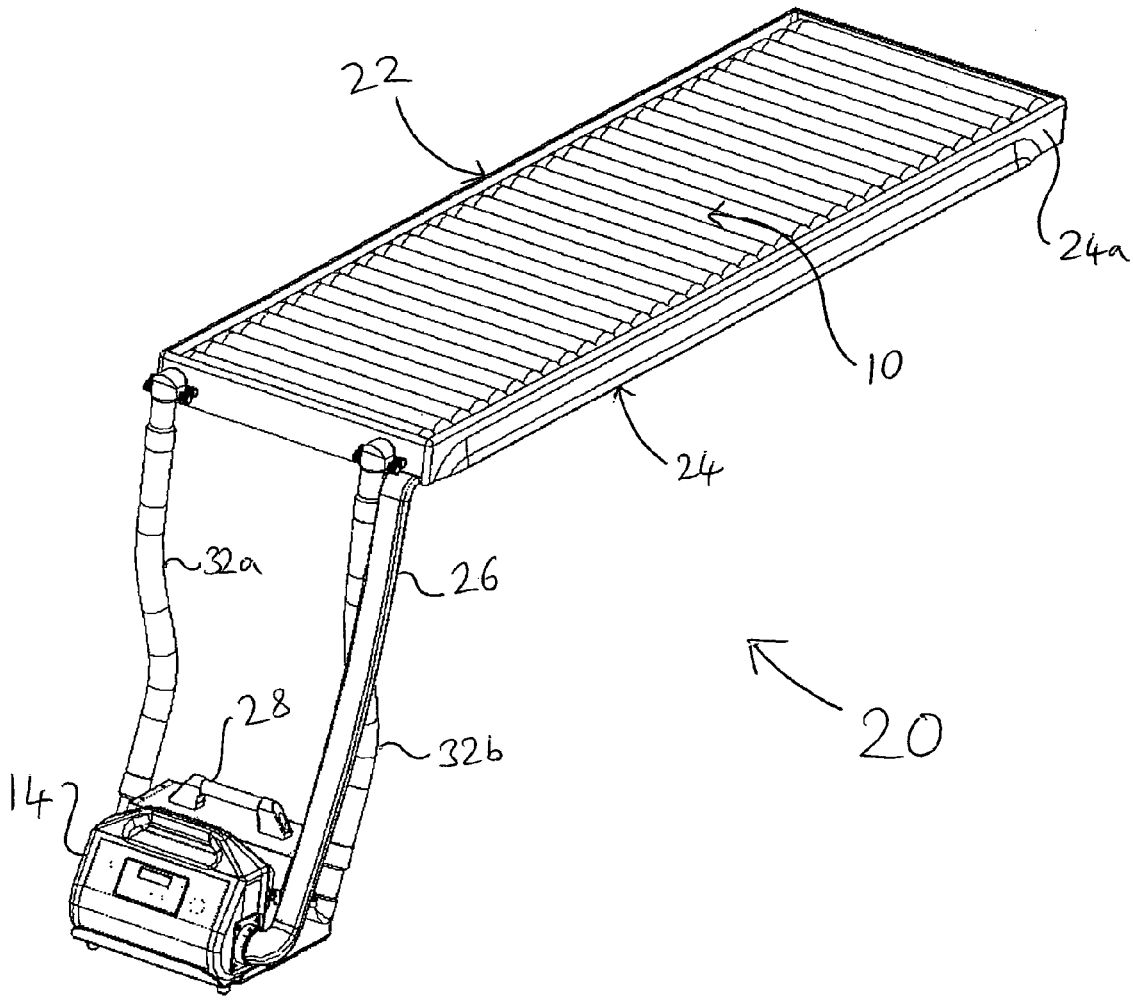
FIG. 2 is a perspective view of a mattress system in accordance with a preferred embodiment of the present invention.

A preferred embodiment of a mattress system 20 in accordance with the present invention is shown in FIG. 2. This example is an operating room application where a temperature in the range 25 to 40° C. is typically required at the load-bearing mattress surface.

Figure 2A:
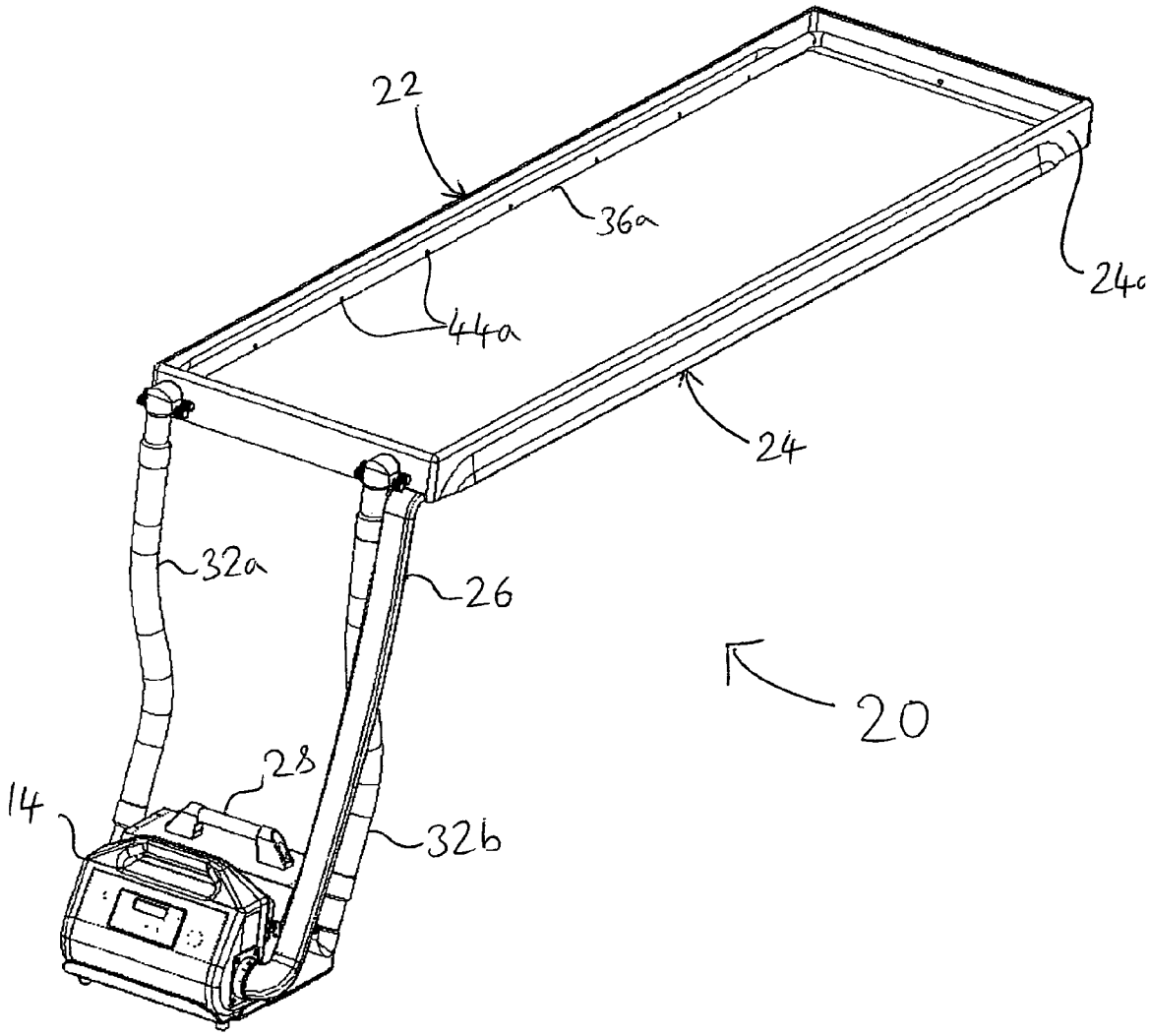
FIG. 2*a* is a perspective view of the mattress system of FIG. 2 with the internal mattress not shown.

The mattress system 20 in FIG. 2 comprises a mattress 22 having a mattress cover 24 enclosing an internal inflatable mattress 10. Between the internal inflatable mattress 10 and the mattress cover 24 there is a mattress air chamber 30. The mattress air chamber 30 is not clearly shown in FIG. 2, but it can be seen in the schematic plan view of FIG. 4, described below. Furthermore, the mattress system 20 is also depicted in FIG. 2*a* without the internal inflatable mattress 10 so that other components can be more clearly seen.

In the preferred embodiment of FIG. 2, the internal inflatable mattress is a dynamic pressure-relieving mattress 10 as described above with reference to FIG. 1. The internal inflatable mattress 10 is connected to its associated pump and control unit 14 by means of a flexible conduit 26. The flexible conduit 26 encloses the four air hoses 16*a*, 16*b*, 16*c* and 16*d* for inflating and deflating the four separate inflation chambers 12*a*, 12*b*, 12*c* and 12*d* of the internal inflatable mattress 10.

The mattress system 20 further comprises a heater-blower unit 28 connected to the mattress air chamber 30 by means of inlet and outlet hoses 32*a* and 32*b*. In this embodiment, the heater-blower unit is disposed outside the mattress. The system is able to provide a temperature-controlled airflow through the air chamber 30 by means of the heater-blower unit 28. The heater-blower unit 28 of the mattress system 20 will now be described in more detail with reference to FIG. 3.

The heater-blower unit 28 has a housing 46 through which there is an air passageway 48 which runs between an air inlet 49*b* and an air outlet 49*a* of the housing 46. The air passageway contains a fan 50, a heater 52 and two temperature sensors 54 and 56. The fan 50 and the heater 52 are each disposed between the air inlet 49*b* and the air outlet 49*a*. The heater 52 is in fact disposed between the fan 50 and the air outlet 49*a*.

The heater-blower unit also includes a processor 58, a display 60 and a control panel 62. The fan 50, the heater 52, the temperature sensors 54 and 56, the display 60 and the control panel 62 are all coupled to the processor as shown by the dashed lines in FIG. 3.

In use, the air outlet 49*a* is connected to the inlet hose 32*a* of the mattress air chamber 30. Similarly, the air inlet 49*b* is connected to the outlet hose 32*b* of the mattress air chamber 30. The fan 50 acts to drive an airflow in the direction shown by arrow 64 from the air inlet 49*a* towards the air outlet 49*b*. Thus, the fan 50 drives an airflow out of the air passageway 48 of the heater-blower unit 28 via the air outlet 49*a*. The airflow is then driven through the hose 32*a* into the mattress air chamber 30. Having passed through the mattress air chamber 30, the airflow is driven through the hose 32*b* and back into the air passageway 48 of the heater-blower unit via the air inlet 49*b*. Thus, a continuous circulation of air is provided between the heater-blower unit and the connected mattress air chamber 30. The airflow driven by the fan 50 is a non-pressurised airflow. Thus, there is no pressurised cushion of air formed within the mattress air chamber 30. This ensures that any therapy provided by the internal pressure-relieving mattress 10 is not compromised since the patient's bodyweight is effectively supported by the internal mattress 10 rather than by the mattress air chamber 30.

The control panel 62 is used to operate the mattress temperature control system. In particular, a power button on the control panel 62 is used to switch on the heater-blower unit 28. After switch on, the heater-blower unit 28 adopts a standby mode. Pressing the power button again invokes the run mode, in which the fan 50 starts and thermal control of the mattress air chamber 30 is initiated. The control panel 62 is also used to select a desired temperature of the airflow within the mattress air chamber 30. However, the heater-blower unit 28 may initially operate at a default desired temperature (e.g. a body temperature of 37° C.).

When the heater 52 is in operation, the airflow is heated as it passes the heater 52. The temperature sensors 54 and 56 sense the temperature of the local airflows.

The first temperature sensor 54 is arranged to sense the temperature of a first airflow which passes from the heater 52, along the mattress inlet hose 32*a* and into the mattress air chamber 30. In this embodiment, the first temperature sensor 54 is disposed near the air outlet 49*a*. In particular, the first temperature sensor 54 is disposed within the air passageway 48 of the heater-blower unit 28 between the heater 52 and the air outlet 49*a*. However, the first temperature sensor 54 may alternatively be disposed outside the heater-blower unit 28. For example, the first temperature sensor 54 may be disposed at any location in the first airflow between the heater 52 and the mattress air chamber 30 (e.g. at/near either end of the mattress inlet hose 32*a*).

The return temperature sensor 56 is arranged to sense the temperature of a return airflow which passes out of the mattress air chamber 30, along the mattress outlet hose 32*b* and back into the heater 52. In this embodiment, the return temperature sensor 56 is disposed near the air inlet 49*b*. In particular, the return temperature sensor 56 is disposed within the air passageway 48 of the heater-blower unit 28 between the air inlet 49*b* and the fan 50. However, the return temperature sensor 56 may alternatively be disposed outside the heater-blower unit 28. For example, the return temperature sensor 56 may be disposed at any location in the return airflow between the mattress air chamber 30 and the heater 52 (e.g. at/near either end of the mattress outlet hose 32*b*).

The processor 58 controls the heater 52 based on the airflow temperatures sensed by both the first and return temperature sensors 54 and 56 an based on the desired temperature selected on the control panel 62. The processor 58 is operable to switch the heater on to increase the airflow temperature, and the processor is operable to switch the heater off to reduce the airflow temperature back towards the ambient air temperature. Thus, the processor 58 is able to control the temperature of the airflow within the mattress air chamber 30 by means of a simple feedback system.

The first temperature sensor 54 is a safety temperature limiting sensor. If the temperature of the first airflow deriving from the heater 52 exceeds a specified value (e.g. 60° C.), the processor 58 switches off the heater 52, regardless of the temperature sensed by the return temperature sensor 56 and regardless of the desired temperature selected on the control panel 62. The heater 52 is sufficiently powerful to be able to locally heat the surrounding air to a temperature somewhat above the specified safety value (e.g. 60° C.). Thus, when the mattress system 20 is first switched on, the heater 52 tends to be fairly rapidly switched on and off by the processor 58 in response to the temperature sensed by the first temperature sensor 54. For example, consider a situation in which it is desired to heat the mattress air chamber 30 to 37° C. as compared to an ambient air temperature of 20° C. The heater 52 will be turned on straight away and very soon the outgoing air in the first airflow will reach 60° C. At this stage, the heater 52 will be turned off until the temperature of the first airflow (as sensed by the first temperature sensor 54) drops back below 60° C., when the heater 52 will be turned back on again, and so on. This rapid switching on and off of the heater 52 in response to the temperature sensed by the first temperature sensor 54 continues during the initialization phase of the mattress system 20 (i.e. during the period of heating up the mattress air chamber 30 to the desired temperature). After this time, the return temperature sensor 56 takes a more active role.

The return temperature sensor 56 is the primary temperature sensor for managing the temperature of the airflow within the mattress air chamber 30 during normal operation of the mattress system 20 (i.e. once the desired temperature within the mattress air chamber has been reached and must then be maintained). The return temperature sensor 56 measures the temperature of the return airflow from the mattress air chamber 30. If the sensed return airflow temperature is below a specified value, the processor 58 switches on the heater 52. If the sensed return airflow temperature is above the specified value, the heater 52 is stopped. The specified value is related to the desired temperature selected on the control panel 62. Thus, during normal operation of the mattress system 20, the heater 52 tends to be switched on and off by the processor 58 in response to the temperature sensed by the return temperature sensor 56. Alternatively, rather than constantly switching the heater 52 on and off again, a variable power heater could be used to control the temperature of the airflow.

The processor 58 is also operable to control the fan 50. In a preferred embodiment, the fan 50 runs continuously which the mattress system 20 is in operation. Alternatively, the fan 50 may be switched on and off by the processor 58 and the processor may also vary the fan speed in some applications. Operation of the fan 50 may depend on the temperatures sensed by both the first and return temperature sensors 54 and 56 and on the desired temperature selected on the control panel 62 in some applications.

Figure 1:
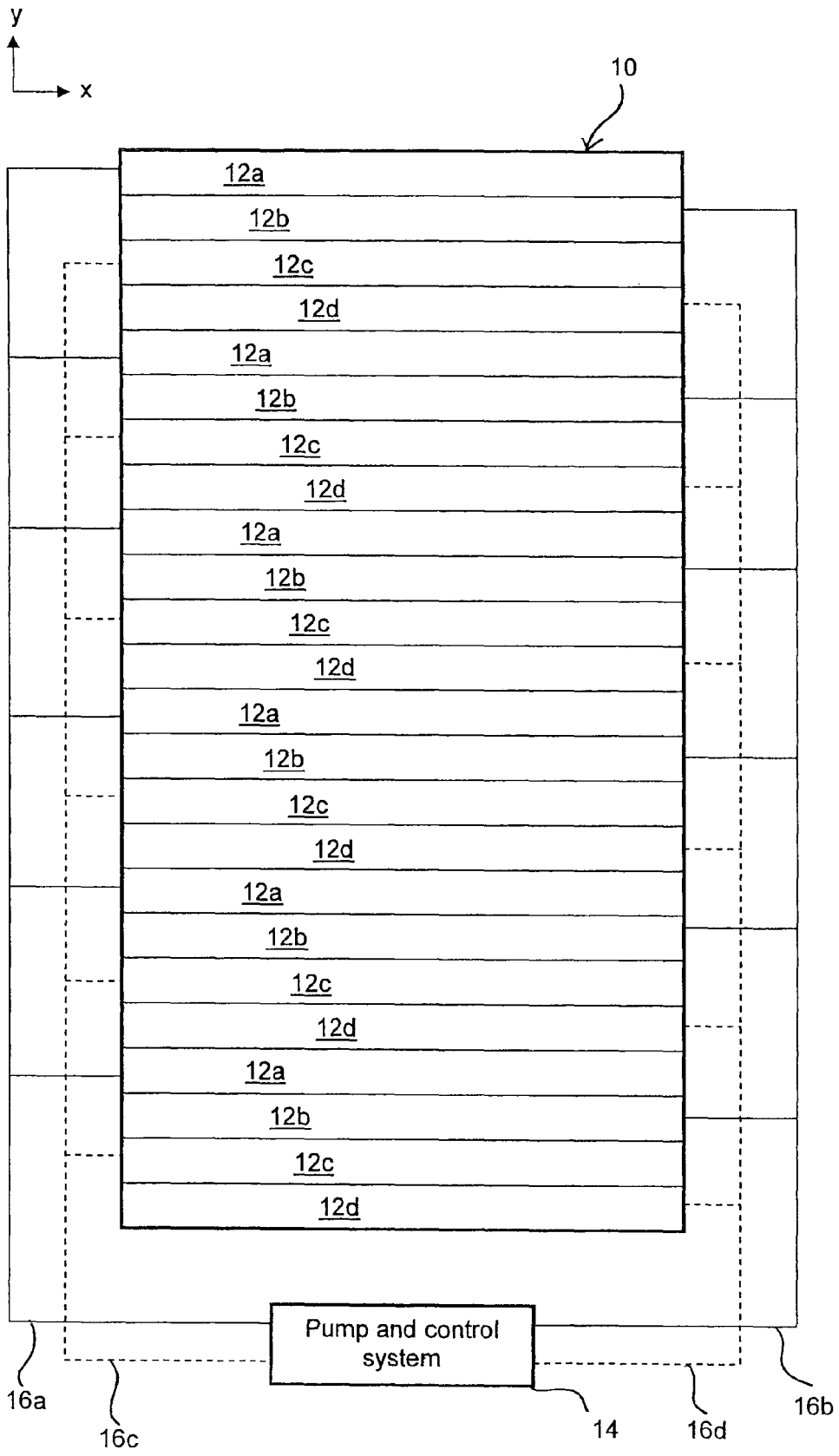
FIG. 1 is a schematic representation of a known dynamic pressure-relieving mattress system.

The pump and control unit 14 of the internal inflatable mattress 10 is independent of the heater-blower unit 28. However, the pump and control unit 14 has an air intake on its back face which abuts the heater-blower unit 28 as shown in FIG. 1. Therefore, in an alternative embodiment, a coupling could be provided between the heater-blower unit 28 and the air intake of the pump and control unit 14 so that temperature-conditioned air is introduced to the inflatable cells 12 of the internal inflatable mattress 10.

Hoses 32*a* and 32*b* have articulated heater hose couplings at either end for connection to the mattress 22 and to the heater-blower unit 28. These articulated couplings provide flexibility of the position of the mattress 22 with respect to the heater-blower unit 28. In addition, the hoses 32*a* and 32*b* are insulated to prevent heat loss (or heat gain in the case of a cooling application rather than a heating application). The heater 52 is able to provide sufficient heat to ensure that the mattress air chamber 30 is maintained at a particular temperature, regardless of heat loss between the mattress air outlet 34*b* and the heater-blower unit 28. Therefore, insulation of the inlet hose 32*a* is generally more important than insulation of the outlet hose 32*b*.

Figure 4:
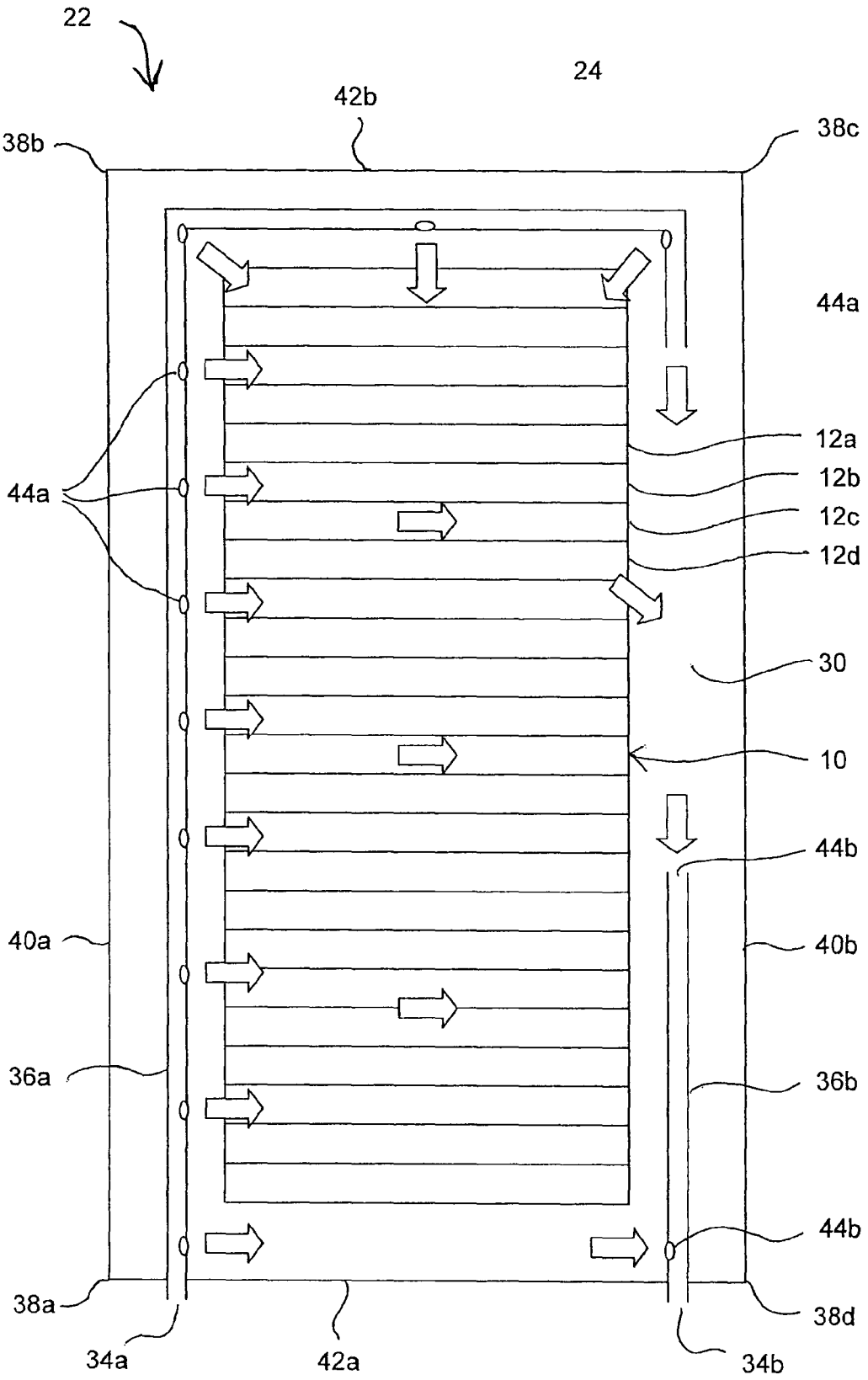
FIG. 4 is a schematic plan view of a mattress used in the embodiment of FIG. 2.

The elongate mattress 22 of the mattress system 20 will now be described in more detail with reference to FIG. 4. For clarity, the internal inflatable mattress 10 is shown in FIG. 4, but the associated flexible conduit 26, hoses 16 and pump and control unit 14 have been omitted. In addition, it should be noted that FIG. 4 is intended to be a schematic representation which is not to scale, etc.

In the plan view of FIG. 4, the mattress 22 has four corners 38*a*, 38*b*, 38*c* and 38*d*. A first longitudinal side 40*a* of the mattress 22 extends between the first and second corners 38*a* and 38*b*. A second longitudinal side 40*b* of the mattress 22 extends between the third and fourth corners 38*c* and 38*d*. A first widthwise side 42*a* of the mattress 22 extends between the first and fourth corners 38*a* and 38*d*. A second widthwise side 42*b* of the mattress 22 extends between the second and third corners 38*b* and 38*c*.

The mattress cover 24 has two apertures in the first widthwise side 42*a* of the mattress, the first aperture forming an inlet 34*a* to the air chamber 30 and the second aperture forming an outlet 34*b* from the air chamber 30. The air chamber inlet 34*a* is located near the first corner 38*a* of the mattress 22. The air chamber outlet 34*b* is located near the fourth corner 38*d* of the mattress 22. In use, the air chamber inlet 34*a* is connected to the air outlet 49*a* of the heater-blower unit 28 by means of the mattress inlet hose 32*a*. Similarly, the air chamber outlet 34*b* is connected to the air inlet 49*b* of the heater-blower unit 28 by means of the mattress outlet hose 32*b*. Thus, air supplied from the heater-blower unit 28 is distributed within the mattress air chamber 30 around the outside of the inflatable cells 12 of the internal inflatable mattress 10.

An air inlet conduit 36*a* extends within the air chamber 30. The air inlet conduit 36*a* extends along a peripheral portion of the mattress 22 from the air chamber inlet 34*a*. In this embodiment, the air inlet conduit 36*a* extends along the first longitudinal side 40*a* of the mattress 22 to the second corner 38*b*. The air inlet conduit 36*a* further extends along the second widthwise side 42*b* of the mattress 22 from the second corner 38*b* to the third corner 38*c*. The air inlet conduit 36*a* then partially extends back along the second longitudinal side 40*b* of the mattress 22 from the third corner 38*c* towards the fourth corner 38*d*.

An air outlet conduit 36*b* also extends within the air chamber 30. The air outlet conduit 36*b* extends along a peripheral portion of the mattress 22 from the air chamber outlet 34*b*. In this embodiment, the air outlet conduit 36*b* extends approximately one third of the way along the second longitudinal side 40*b* of the mattress 22 from the air chamber outlet 34*b* towards the third corner 38*c* of the mattress 22.

Figure 3:
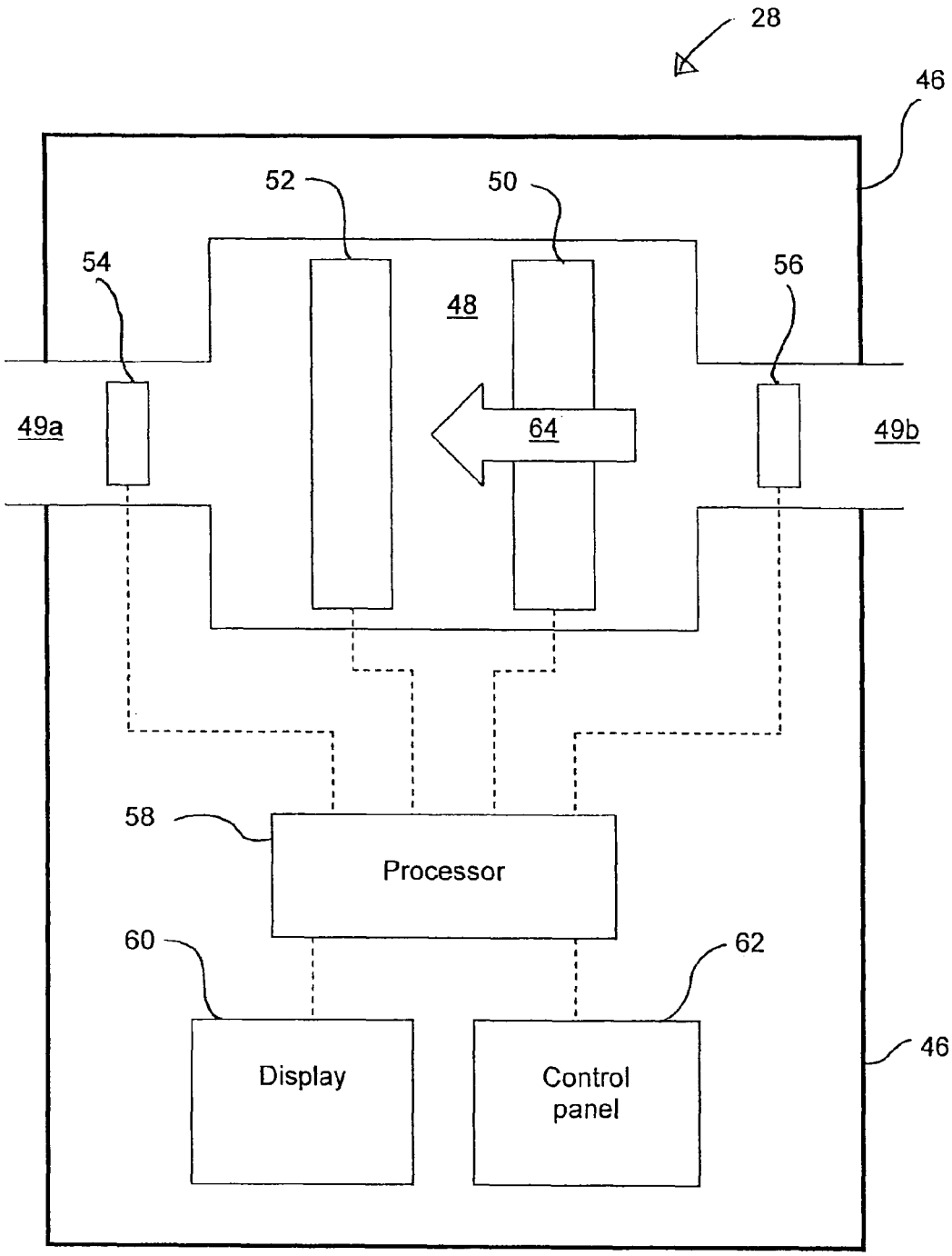
FIG. 3 is a schematic representation of a heater-blower unit used in the embodiment of FIG. 2.

The conduits 36*a* and 36*b* are each formed from a flexible hose or tube in the embodiment of FIGS. 2-4. In alternative embodiments, any form of conduit suitable for carrying an air supply may be used. For example, the conduits 36*a* and 36*b* may be rigid or semi-rigid rather than flexible. Alternatively, the conduits 36*a* and 36*b* may be formed by the assembly of films or textiles integral to the mattress construction, rather than by discrete hoses.

The air inlet conduit 36*a* has a plurality of mutually spaced holes 44*a* for introducing the temperature-conditioned airflow from the heater-blower unit 28 into the mattress air chamber 30 at a plurality of locations. The airflow is depicted schematically by block arrows in FIG. 4. As shown in FIG. 4, the holes 44*a* are approximately evenly spaced along the length air inlet conduit 36*a*. The majority of the holes are disposed in a side of the air inlet conduit 36*a* so as to direct the air into the central portion of the air chamber 30 rather than towards the mattress cover 34. One of the holes 44*a* is the opening at the far end of the hose which forms the air inlet conduit 36*a*. The air outlet conduit 36*b* has two holes 44*b* for conveying the temperature-conditioned airflow out of the mattress air chamber 30. One of the holes 44*b* is near the air chamber outlet 34*b*, and the other hole is the opening at the far end of the hose which forms the air outlet conduit 36*b*.

In a preferred embodiment, the air inlet conduit 36*a* and the holes 44*a* are arranged to provide a substantially constant temperature distribution of the airflow within the mattress air chamber 30. Alternatively, the air inlet conduit 36*a* and the holes 44*a* may be arranged to provide a temperature distribution of the airflow within the mattress air chamber 30 which varies along the length of the mattress 22. For example, it may be desirable to provide an elevated temperature in the central portion of the mattress air chamber 30 as compared to the temperature at either end of the mattress air chamber 30. This would act to heat the thorax of a patient on the mattress to a higher temperature than their head and feet. Such a temperature distribution may provide the most efficient patient heating in some circumstances.

There are a number of ways of varying the temperature distribution within the mattress air chamber 30 by means of the air inlet conduit 36*a* and the holes 44*a*. For example, a greater number of holes 44*a* and/or larger holes 44*a* may be provided in the air inlet conduit 36*a* in a region of the mattress air chamber 30 where a relatively high temperature is required compared to the rest of the mattress air chamber 30. Alternatively, the air inlet conduit 36*a* may be disposed in a different arrangement within the mattress air chamber 30. For example, in one alternative embodiment, the air inlet conduit 36*a* may terminate at the second corner 38*a* such that it only extends along the first longitudinal side 40*a* of the mattress 22. This would lead to a reduced temperature at the far end of the mattress air chamber (i.e. near the second and third corners 38*b* and 38*c* and the second widthwise side of the mattress 22) as compared to the arrangement shown in FIG. 4 since less warm air would be introduced into the mattress air chamber 30 at the far end of the mattress air chamber 30 due to the reduced number of entrance points (i.e. holes 44*a*) in that region of the mattress air chamber 30.

Thus, the sizes and locations of the holes 44*a* are provided so as to alter the temperature along the length of the mattress 22 depending on therapy requirements. However, the sizes and locations of the holes 44*a* and 44*b* may be also optimised to prevent localised heating on the load-bearing surface of the mattress 22 across its width and to prevent excessive back pressure in the blower system.

The mattress cover 24 is formed from a base tray 24*a* overlaid by an attached flexible coversheet (not shown). The coversheet is attached to the base tray 24*a* by zips, for example. There are sealed seams to prevent significant leakage of air or fluids. The mattress air chamber 30 is therefore substantially closed. The fact that it is only "substantially" closed is related to a number of factors. For example, the coversheet (i.e. the upper surface of the mattress cover 24) is gas permeable (i.e. breathable), but is liquid impermeable and moisture resistant. Also, the mattress cover 24 is substantially sealed, but not perfectly sealed. For example, the seal may be formed by a zip and an over-flap arrangement. Thus, there is a small amount of natural air aspiration through the mattress cover 24.

The mattress cover 24 is constructed of polyurethane and knitted nylon and is thus stretchable, which helps to ensure that the benefits of a dynamic pressure-relieving internal mattress are not lost when used in combination with the heater-blower unit 28.

The lower surface of the mattress (i.e. the surface opposite the upper load-bearing surface) may comprise an insulating layer. For example, an insulated layer may be permanently fitted to an inner face of a base tray of the mattress 22 to minimize heat loss other than through the load-bearing surface of the mattress 22.

In a preferred embodiment, the mattress 22 is radio-lucent. This is achieved by forming all the components of the mattress 22 (e.g. the internal mattress 10, the mattress cover 24, the air inlet conduit 36*a* and the air outlet conduit 36*b* from materials which are radio-lucent (i.e. materials which do not exhibit radio-opacity). This enables an x-ray to be taken of a patient lying on the mattress 22 without compromising the quality of the x-ray picture. The internal inflatable mattress 10 may have a static mode of operation (as opposed to the dynamic pressure-relieving mode of operation described above) to ensure that there is no movement of the patient during X-ray imaging.

Although the use of an internal mattress 10 in the form of a dynamic pressure-relieving mattress is preferred, it should be noted that this is not an essential feature of the invention. For example, a more basic inflatable mattress with a single inflation chamber could instead be used. Alternatively, an internal mattress 10 in the form of a sealed foam mattress could be used. Clearly, the pump and control unit 14 could be omitted in these embodiments.

Although preferred embodiments of the invention have been described, it is to be understood that these are by way of example only and that various modifications may be contemplated.

The invention claimed is:

1. A mattress system comprising:

a mattress enclosed by a mattress cover such that a void is created directly between the mattress and the mattress cover, the void forming a mattress air chamber;

an airflow driving device in fluid communication with the mattress air chamber via an air chamber inlet and an air chamber outlet, the airflow driving device being operable to drive a substantially non-pressurized airflow through the mattress air chamber around the outside of the mattress from the air chamber inlet to the air chamber outlet such that the air flow contacts all exterior sides of the mattress and such that a weight of a user on the mattress system is wholly supported by the mattress rather than by either the mattress air chamber or the substantially non-pressurized airflow through the mattress air chamber;

a heat adjustment unit for heating or cooling the airflow so as to control a temperature of the airflow within the mattress air chamber; and a return temperature sensor arranged to sense a temperature of a return airflow from the air chamber outlet to the heat adjustment unit.

2. The mattress system of claim 1 further comprising an air inlet conduit extending within the mattress air chamber from the air chamber inlet, the air inlet conduit comprising a plurality of mutually spaced holes for introducing the temperature-controlled airflow into the mattress air chamber at a plurality of locations.

3. The mattress system of claim 2 wherein the air inlet conduit and the holes are arranged to provide a substantially constant temperature distribution of the airflow within the mattress air chamber.

4. The mattress system of claim 2 wherein the mattress is elongate and the air inlet conduit and the holes are arranged to provide a temperature distribution of the airflow within the mattress air chamber which varies along the length of the mattress.

5. The mattress system of claim 2 wherein the mattress is elongate and the air chamber inlet is located at or near a first corner of the mattress such that the air inlet conduit extends along a longitudinal edge of the mattress towards a second corner of the mattress.

6. The mattress system of claim 5 wherein the air inlet conduit further extends from the second corner of the mattress along a widthwise edge of the mattress towards a third corner of the mattress and then partially extends back along an opposite longitudinal edge of the mattress towards a fourth corner of the mattress.

7. The mattress system of claim 1 further comprising a temperature sensor arranged to sense a temperature of the airflow.

8. The mattress system of claim 7 wherein the temperature sensor comprises a first temperature sensor arranged to sense a temperature of a first airflow from the heat adjustment unit to the air chamber inlet.

9. The mattress system of claim 7 further comprising a processor operable to control the heat adjustment unit based on the sensed airflow temperature.

10. The mattress system of claim 9 further comprising means for selecting a desired temperature distribution of the airflow within the mattress air chamber, the processor further being operable to control the heat adjustment unit based on the selected temperature distribution.

11. The mattress system of claim 1 wherein the mattress has a load-bearing upper surface for receiving a load, and the lower surface of the mattress comprises an insulating layer.

12. The mattress system of claim 1 wherein the mattress is radiolucent.

13. A mattress system comprising:

a mattress enclosed by a mattress cover such that a void is created directly between the mattress and the mattress cover, the void forming a mattress air chamber;

an airflow driving device in fluid communication with the mattress air chamber via an air chamber inlet and an air chamber outlet, the airflow driving device being operable to drive a substantially non-pressurized airflow through the mattress air chamber around the outside of the mattress from the air chamber inlet to the air chamber outlet such that the air flow contacts all exterior sides of the mattress and such that a weight of a user on the mattress system is wholly supported by the mattress rather than by either the mattress air chamber or the substantially non-pressurized airflow through the mattress air chamber;

a heat adjustment unit for heating or cooling the airflow so as to control a temperature of the airflow within the mattress air chamber; and an air outlet conduit extending within the mattress air chamber to the air chamber outlet, the air outlet conduit comprising at least one hole for conveying the temperature-controlled airflow out of the mattress air chamber.

14. The mattress system of claim 13 wherein the mattress is elongate having first, second, third, and fourth corners, and wherein the air chamber outlet is located adjacent the fourth corner of the mattress and the air outlet conduit extends approximately one third of the way along a longitudinal edge of the mattress towards the third corner of the mattress.

15. A mattress system comprising:

an inflatable mattress enclosed by a mattress cover such that a void is created directly between the inflatable mattress and the mattress cover, the void forming a mattress air chamber;

an airflow driving device in fluid communication with the mattress air chamber via an air chamber inlet and an air chamber outlet, the airflow driving device being operable to drive a substantially non-pressurized airflow through the mattress air chamber around the outside of the mattress from the air chamber inlet to the air chamber outlet such that the air flow contacts all exterior sides of the mattress; and a heat adjustment unit for heating or cooling the airflow so as to control a temperature of the airflow within the mattress air chamber;

wherein the inflatable mattress comprises at least two separate inflation chambers that are inflatable independently of one another to a desired inflation pressure, and wherein the inflatable mattress is independent of the airflow driving device in fluid communication with the mattress air chamber such that a weight of a user on the mattress system is wholly supported by the inflatable mattress rather than by either the mattress air chamber or the substantially non-pressurized airflow through the mattress air chamber.

16. The mattress system of claim 15 wherein each inflation chamber comprises a respective plurality of mutually spaced inflatable cells.

17. The mattress system of claim 15 further comprising a pump and a control system operable to independently vary the inflation pressure of each inflation chamber over time.

* * * * *